United States Patent [19]

Chang

[11] Patent Number: 4,679,527

[45] Date of Patent: Jul. 14, 1987

[54] MAGNETIC BRUSH DEVELOPER

[75] Inventor: Phillip Chang, Boulder, Colo.

[73] Assignee: International Business Machines Corporation, Armonk, N.Y.

[21] Appl. No.: 813,783

[22] Filed: Dec. 27, 1985

[51] Int. Cl.[4] ..... G03G 15/09

[52] U.S. Cl. ..... 118/658; 355/3 DD

[58] Field of Search ..... 118/658; 355/3 DD

[56] References Cited

U.S. PATENT DOCUMENTS 4,354,454 10/1982 Nishikawa ..... 118/658

4,439,034 3/1984 Daniels ..... 118/658

*Primary Examiner*—Bernard D. Pianalto

*Attorney, Agent, or Firm*—Perman & Green

[57] ABSTRACT

A magnetic brush developer includes a magnetic brush roll having a magnet assembly which includes a development magnet, positioned at the nip between the magnetic brush roll and a photoconductive surface, at least one transport magnet and a pre-nip magnet arranged between the development magnet and the transport magnet adjacent the development magnet and so spaced from the transport magnet so as to create a tangential field therebetween. A mix barrier is arranged between the transport magnet and the pre-nip magnet to limit the flow of developer mix from a supply source to the developer nip. This combination enables the maintenance of stable flow rates and pressures of the developer mix at the development zone with non-critical tolerancing of the mix barrier.

15 Claims, 3 Drawing Figures

MAGNETIC BRUSH DEVELOPER

FIELD OF THE INVENTION

This invention relates to magnetic brush development apparatus for the development of electrostatic latent images on an imaging surface and to electrostatographic machines incorporating same.

BACKGROUND OF THE INVENTION

In electrophotogaphic machines, a photoconductive surface is charged in a uniform manner and then exposed to light reflected from an original to be copied. That light variably discharges the photoconductive material thus providing a latent electrostatic image of the original on the photoconductive surface. The image is then developed through the application of toner which typically is a black powdery substance electrically attracted to the undischarged areas of the image. After development, the image is transferred to a piece of copy paper or some other substrate and fused thereto.

Magnetic brush developers provide high quality development of latent images. These developers generally comprise a rotating hollow shell made of non-magnetic material with numerous stationery magnets disposed within. A developer mix for use in such a system may be composed of a single component or two components. A two-component developer is typically comprised of small steel particles or beads, called carrier, which are magnetically attracted to the surface of the rotating roll by virtue of the magnets disposed therein, and the above-mentioned toner particles. The small steel beads are coated with the black powdery toner, which adheres triboelectrically to them, and carry the toner along the surface of the magnetic brush roll into the development zone where the toner may be electrically attracted from the steel beads to the latent image. A single component developer mix for use in a magentic brush developer will comprise electrically conductive, magnetic marking particles.

Typical magnetic brush developers are shown in U.S. Pat. Nos. 3,999,514 and 4,161,923 to Abbott et al and assigned to the same assignee. The developers described in the aforesaid patents have single developer roll development, and in order to improve the development characteristics of such systems, a number of multiroll development systems have been proposed in which two or more magnetic brush rolls are arranged along the photoconductor. U.S. Pat. No. 4,439,034 to Daniels, which is also assigned to the same assignee, is illustrative of a multiroll system in which developer material is carried from one developer roll to the next in contact with the imaging surface.

As will be noted by reference to the aforesaid patents, the magnetic brush developer rolls include pick-up and transport magnets for conveying the developer material to the development zone. At the development zone a development magnet is located opposite the nip between the magnetic brush roll and the photoreceptor surface. In magnetic brush developers it is important to achieve steady and uniform carrier bead flow from the pick-up area to the development zone. In that manner an ample supply of toner will be provided to develop the latent image. Typically, in order to control the flow of developer material to the development zone, a so called doctor rod or doctor blade is arranged to control the height of developer material on the brush roll, as for example, in aforesaid U.S. Pat. Nos. 3,999,514 and 4,161,923.

Other examples of magnetic brush developer systems utilizing doctor rods are as follows:

IBM Technical Disclosure Bulletin, September 1972, Page 1251, shows a developer with a doctor rod positioned at a transitional area just after the transport magnet.

IBM Technical Disclosure Bulletin, February 1972, Page 2787, also shows a doctor rod positioned just after a transport magnet.

U.S. Pat. No. 4,377,334 to Nishikawa relates to a developer roll with a doctor rod positioned between the development magnet and a transport magnet. The doctor blade is described as providing a given thickness of developer material as it enters the development zone.

U.S. Pat. No. 4,354,454 to Nishikawa relates to a counterflow developer with a doctor rod located similarly to that of U.S. Pat. No. 4,377,334 above.

U.S. Pat. No. 4,347,299 to Ozawa et al relates to a method of controlling toner concentration In the course of the description, a doctor blade is shown positioned prior to a development nip in the conventional manner.

U.S. Pat. No. 4,334,772 to Suzuki relates to a developer with a very small nip gap. A doctor blade is positioned prior to the nip gap in a conventional manner.

U.S. Pat. No. 4,257,348 to Prohaska relates to a magnetic brush developer where the doctor rod is essentially buried in the developer mix. This doctor blade is designed to limit the thickness of the brush.

U.S. Pat. No. 4,200,665 to Suzuki et al relates to toner concentration but shows a doctor rod positioned in the conventional manner although it is nearly buried in the mix.

U.S. Pat. No. 4,030,447 to Takahashi et al relates to a doctor blade which is positioned in such a manner that any material scraped away by the blade is buried in the mix.

In the prior art magnetic brush systems employing doctor rods, as exemplified by the systems described above, in which the doctor blade adjusts the height of the developer brush to a predetermined height, it has been necessary that the doctor rod be set in dependence upon the size of the nip gap between the developer roll and the photoreceptor. This is because the pressure in the nip gap is found to vary according to the setting of the doctor rod. This has meant in the past that doctor rods have in practice needed to be adjustable to enable the setting of the nip gap and doctor rod to be closely matched.

The inventor herein has discovered that this requirement can be avoided by providing a relatively weak pre-nip magnet just ahead of the development magnet, and having the same polarity as the development magnets which creates a tangential field between itself and the transport magnet. Also provided is a mechanism, similar to a doctor rod but more appropriately referred to as a mix barrier, which is arranged in the tangential field area between the prenip magnet and the transport magnet. Preferably, the mix barrier is placed at a transition point fairly close to the transport magnet and not directly in the middle of the tangential field. The result is that developer mix is held to the surface of the magnetic brush by the tangential field in a fairly solid rod-like manner and any additional material is easily peeled away by the mix barrier. The pre-nip magnet serve to pre-condition the pre-nip packing of the developer. As the setting of the mix barrier changes, the pressure in the nip remains constant since the amount of mix going to the nip is determined more by the amount packed into the tangential field than the extra amount peeled away by the mix barrier. If the nip gap changes, the pressure in the nip changes; however, it still retains its independence relative to the mix barrier setting.

Thus, with this arrangement, there is provided a developer configuration which provides relatively uniform pressure in the nip gap regardless of the size of the gap. It also provides independence in the setting of a doctor rod relative to the size of the nip gap. That is, this configuration has removed the criticality of setting the nip-gap and as well as the criticality of setting the doctor rod. By stabilizing flow rates in this way, enhanced and uniform copy quality can be obtained from one machine to another and manufacturability with a minimum of adjustments and calibrations can be achieved.

The benefits, particularly of the preferred embodiments, of the invention include increased design flexibility, increased latitude in mechanical tolerancing, ability to transport a variety of developer mixes, enhanced and uniform copy quality through flow stability and simplicity. Cost reduction is possible since close tolerancing and parts for adjustable doctor rods can be eliminated and the mix barrier can be part of the developer housing. Further cost reduction can be obtained by elimination or reduction of developer and copier tests and calibrations normally required prior to shipment. Cost reduction can also be achieved during field replacements of developers and photoconductor members.

SUMMARY OF THE INVENTION

The invention provides a magnetic brush development apparatus in which a magnetic brush roll transfers developer from a supply source to a photoreceptor utilizing one or more transport magnets and a development magnet. A pre-nip magnet is arranged between the development magnet and the transport magnet adjacent the development magnet and has the same polarity as the development magnet. The pre-nip magnet is so spaced from the transport magnet as to create a tangential field therebetween. Further, a mix barrier (doctor rod) may be located in the tangential field. This combination enables the maintenance of stable flow rates and pressures at the development zone with non-critical tolerancing of the doctor rod.

The invention is of particular value in a multi-roll parallel flow developer with small developer nip gaps using regular-shaped coated carrier. In such case, the above-described developer roll forms the first roll of the developer roll array.

BRIEF DESCRIPTION OF THE DRAWINGS

The above mentioned and other features and objects of this invention and the manner of obtaining them will become more apparent and the invention itself will best be understood by reference to the following description of embodiments of the invention taken in conjunction with the accompanying drawings, a description of which follows.

DETAILED DESCRIPTION

Figure 1:
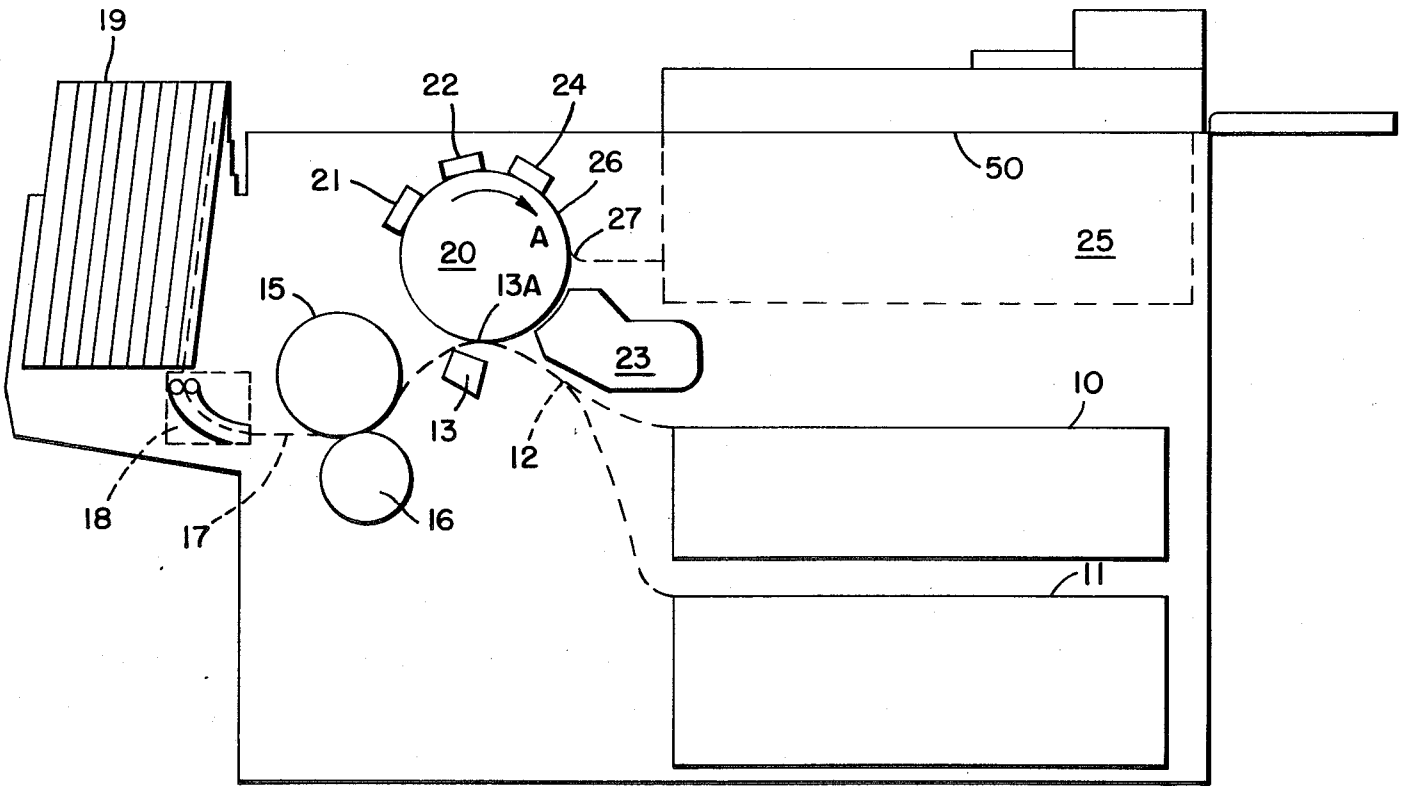
FIG. 1 illustrates schematically an electrophotographic machine in which the invention is practiced.

Referring now to FIG. 1, there is shown schematically a typical electrophotographic machine of the transfer type. Copy paper is fed from either of paper bins 10 and 11 to a transfer station 13*a* located just above a transfer corona 13. At that station an image is placed upon the copy paper. The copy paper continues through the fusing rolls 15 and 16 where the image is firmly attached to the copy paper. Then the paper continues along path 17 into a movable deflector 18 and from there into one of the collator bins 19.

In order to produce an image on the photoconductor surface 26, the document to be copied is placed upon a glass platen 50. An image of that document is transferred to the photoconductive surface 26 through an optics module 25 producing that image on the photoconductor surface 26 at exposure station 27. The photoconductive surface 26 has previously been charged by a charge corona 21 to place a relatively uniform electrostatic charge, usually several hundred volts across the entirety of the photoconductor surface. In this embodiment the photoconductor surface is formed as the surface of a drum 20 although it could equally be formed as the surface of an endless belt.

As the drum 20 continues to rotate in the direction A, developer 23 develops the image which is then transferred to the copy paper. As the photoconductor further rotates, it comes under the influence of a preclean corona 22 and an erase lamp 24 which discharge all of the remaining charged areas of the photoconductor. The photoconductor continues to pass around and through the developing station 23 until it reaches the charge corona 21 where the photoconductor 26 is again charged prior to receiving another image at exposure station 27.

Many suitable designs of optics system are available and one example is to be found in aforesaid U.S. Pat. No. 4,466,731, the disclosure of which is hereby incorporated by reference herein in its entirety.

Figure 2:
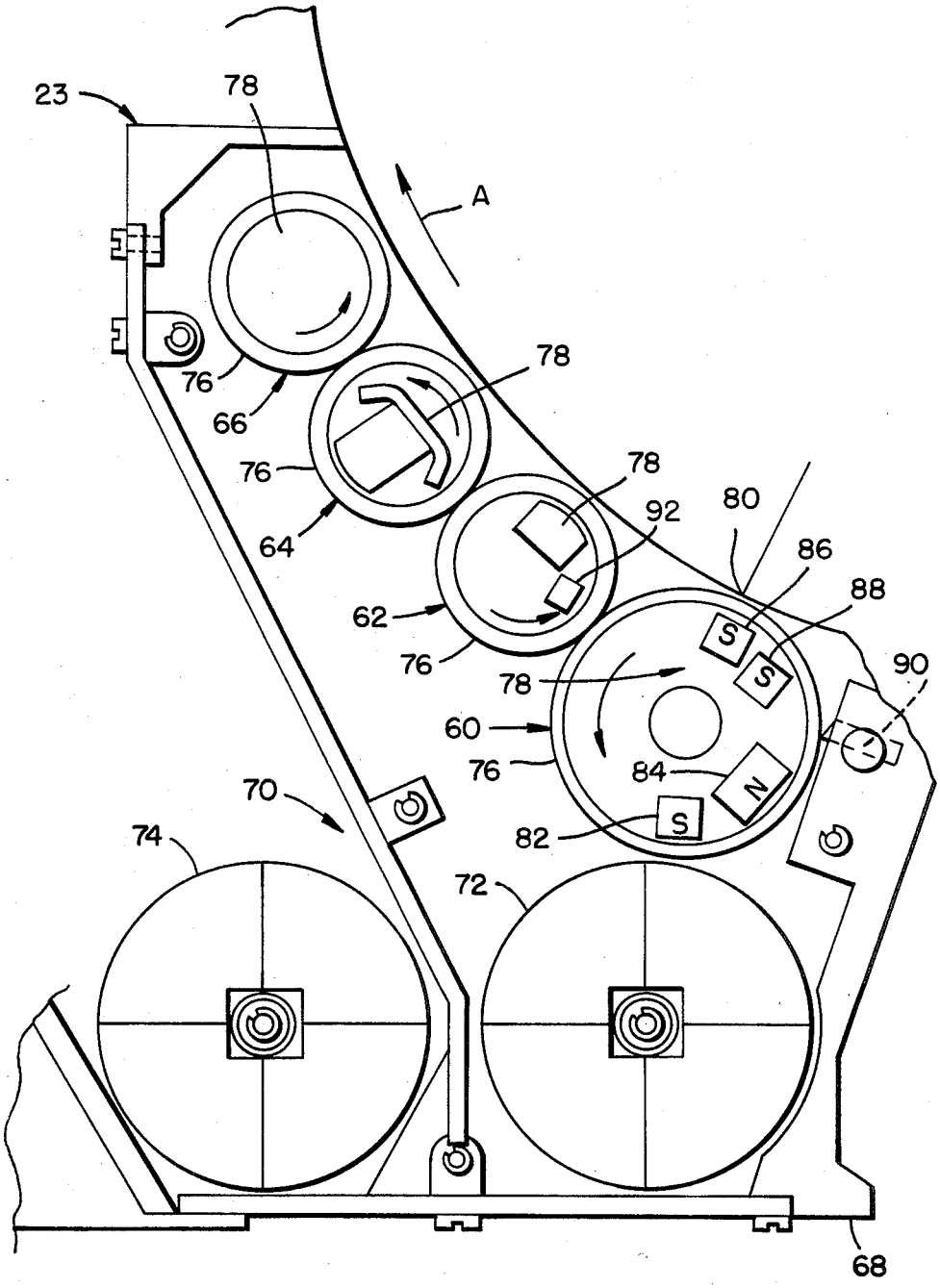
FIG. 2 is a side sectional view of a magnetic brush developer embodying the present invention.

Referring now to FIG. 2, there is shown a preferred embodiment of development apparatus 23 of this invention. It is a multiroll parallel flow developer system having four magnetic brush rolls 60, 62, 64, and 66 to develop an electrostatic image on the photoconductor 26. To this end, the rolls 60 through 66 are arranged in an array along the circumference of the photoconductor drum and substantially equally spaced therefrom. It is to be noted that the copying machine described above embodies a downhill development configuration which is particularly compatible with a single roll developer system of this invention. The multiroll developer system illustrated in FIG. 2 on the other hand is more suited to an uphill configuration where, as shown, the photoreceptor rotates upwardly past the developer (arrow A) so that the image to be developed meets the developer roll 60 first.

The rolls 60 through 66 are mounted in a housing 68 which also defines a sump 70 for a supply of developer material. In this embodiment, a two-component developer mix is utilized which is comprised of magnetic carrier particles having black powdery toner particles tribo electrically adhering thereto. In a particular form the carrier particles comprise steel beads of regular shape with thin Teflon (Trademark of duPont) coatings or other appropriate polymeric coating.

Alternatively, the invention herein may be used with a single component developer. In this case, the toner would be magnetic and preferably not smaller than about 60 microns.

Within the sump 70 are arranged a supply auger 72 and a return auger 74 which are designed to supply carrier beads coated with toner to the magnetic brush roll 60. Referring to FIG. 2 these augers rotate in a clockwise direction about parallel axes 72 and 75 which lie in a substantially horizontal plane. Supply auger 72 lies beneath the magnetic brush roll 60.

A suitable supply container of toner material (not shown) is provided for replenishing the toner material as it is consumed. Such toner replenishment is preferably effected automatically in response to a toner concentration control apparatus such as described in aforesaid U.S. Pat. No. 4,466,731, the disclosure of which is, as noted above, incorporated by reference herein.

The magnetic brush rolls 60 through 66 each comprise a cylindrical shell 76 of magnetically transparent material, for example, aluminium, which is mounted for rotation about a stationary magnet assembly 78. The shells 76 are arranged to rotate with the magnetic field lines emanating from the magnets causing the magnetically attractable carrier particles to line up in a way resembling the bristles of a brush. As the cylindrical shell 76 rotates, it causes the bristles to collapse and reform according to the magnetic field it is passing through.

The magnet array 78 of the magnetic developer roll 60 includes a plurality of magnets arranged in an arcuate array between the sump 70 and the development zone of the brush roll defined by the nip 80 between the brush roll and the photoconductor surface 26. A pick-up magnet 82 is arranged to collect developer from the developer supply sump 70. Next to the pick-up magnet 82 in the directio towards the development nip 80 is a transport magnet 84 of opposite polarity to the pick-up magnet 82. The transport magnet is arranged to convey the developer material towards a development magnet 86, of opposite polarity to the transport magnet, which is arranged in the development zone opposite the nip 80 between the developer roll 60 and the photoconductive drum surface 26. Immediately ahead of the development magnet 86, and having the same polarity thereto, is a pre-nip magnet 88. This magnet is weaker than the development magnet 86 and is arranged relative to the transport magnet 84 so as to create a tangential magnetic field therebetween as shown in the field plot of the core design illustrated in FIG. 3.

A mix barrier or doctor rod 90 is arranged in spaced relation to the magentic developer roll 60 between the transport magnet 84 and the pre-nip magnet 88. The mix barrier 90 is preferably placed at a transition point fairly close to the transport magnet 84 rather than in the middle of tangential field. The combination of this mix barrier 90 together with the provision of the pre-nip magnet 88 and the arrangement of the latter with respect to the transport magnet 84 so creating the tangential field area results in that of the developer mix is held to the surface of the magnetic brush 60 by the tangential field in a fairly solid rod-like manner and any additional material is easily peeled away by the mix barrier 90.

This arrangement permits relatively uniform pressure in the nip gap 80 regardless of the size of the gap as well as providing independence in the setting of the doctor rod or mix barrier 90 relative to the size of the nip gap. Thus, as the setting of the mix barrier changes, the pressure in the nip remains constant since the amount of mix going to the nip is determined more by the amount packed into the tangential field than the extra amount peeled away by the mix barrier. Stated another way, the interaction of the pre-nip and transport magnets accomplishes a self-adjusting feedback to control material flow and pressure. The mix barrier 90 no longer has to control the developer to a predetermined height; it strips off excess toner and returns it to the sump. What is required to satisfy the nip, whatever its gap may be, is fed back to below the mix barrier 90 and further flow of material is prevented from entering the pre-nip zone. The pre-nip magnet 88 serves to pre-condition the pre-nip packing and the pressure at the nip 80 is independent of the doctoring mechanism 90.

By virtue of this arrangement, the maintenance of stable flow rates and pressures at the development zone are possible with non-critical tolerancing of the doctor rod or mix barrier. Thus, whereas in the past stainless steel doctor rods have been utilized which are adjustably mounted on the developer housing 68, it is now possible to make a doctor rod 90 of other materials, such as aluminum, and have it fixed on the housing 68. Indeed, the mix barrier 90 can now be part of the developer body or housing 68 itself, which is typically extruded aluminum since critical dimensioning is no longer necessary. The mix barrier, besides providing a pivot point for this flow control phenomenon, can act as a seal to prevent free toner caused by the agitation of the mix elements from migrating above the mix barrier and escaping the developer housing causing machine contamination.

Figure 3:
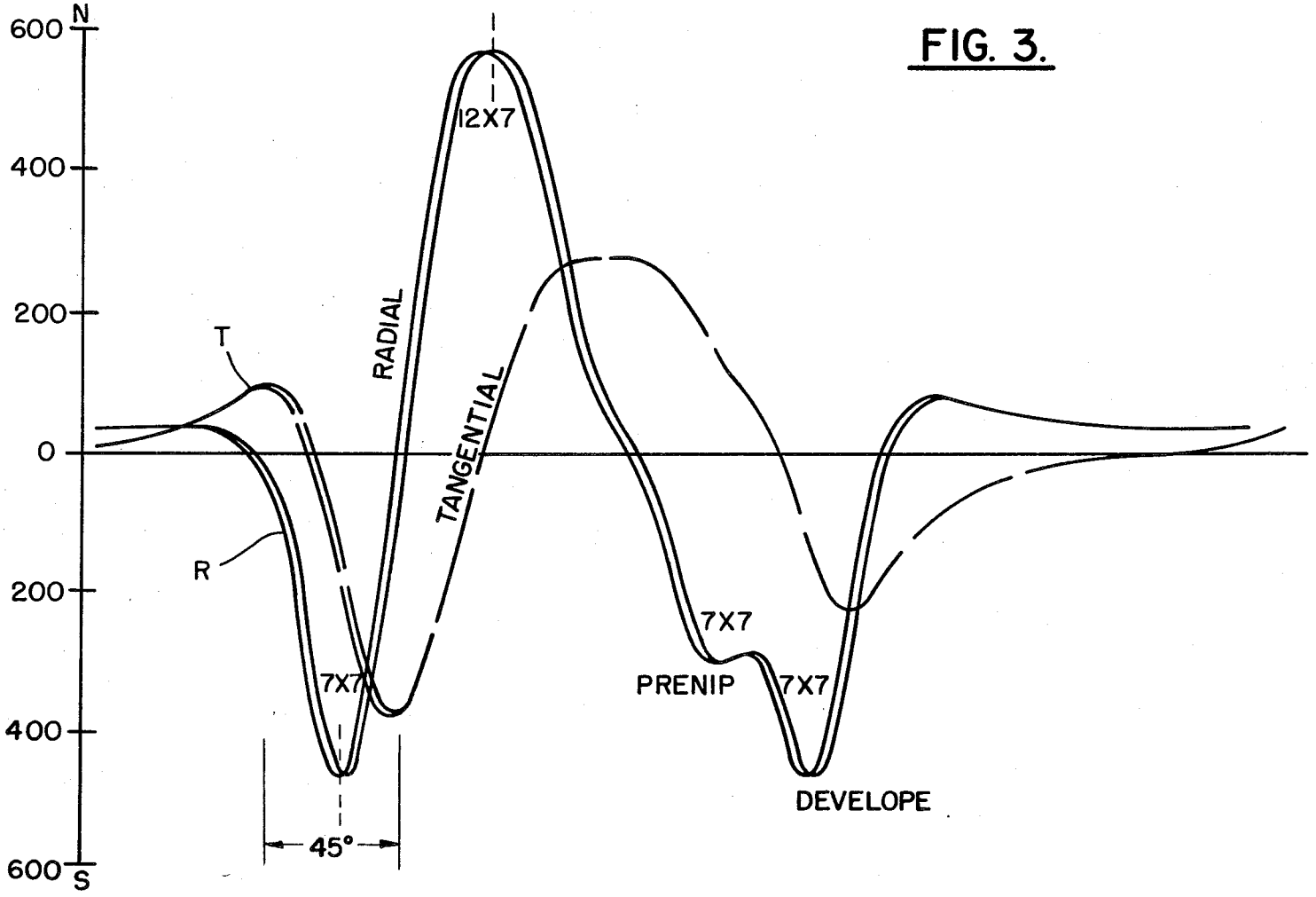
FIG. 3 is a field plot of the magnetic core design of the first brush roll utilized in the magnetic brush developer of FIG. 2.

FIG. 3 is a field plot of the magnetic core of the magnetic array of one embodiment of developer roll 60.

Plot R shows the radial field strengths and illustrates the relative peak values of the various magnets. In order from left to right, the peaks represent the peak values of the pick-up magnet 82, transport magnet 84, pre-nip magnet 88 and the development magnet 86. Plot T shows the tangential field effect produced. The structure of the magnetic field between the pre-nip and transport magnets is thus such that the mix lies down on the developer roll, i.e. is basically flat. The structural strength at this area actually pushes any material that is trying to get past the mix barrier back down into the sump 70 so that the upper part of the mix barrier does not see excessive material.

Where there is enough material for development depending upon the development nip gap size, there is a signal produced by the system back to the mix barrier to keep developer material down in the sump. The geometry of the pre-nip and transport magnets is responsible for this. This geometry includes the relatively great distance apart of these magnets as compared to prior art systems. If the nip gap 80 is small, the system feeds back, by means of the magnetic fieldlines to the mix barrier, the message not to feed further developer material. Thus feedback is the result of the magnetic field lines created by the pre-nip magnet 88 and the transport magnet 84. The magnetic field lines of the pre-nip magnet cause restriction in accordance with nip gap 80.

In the present invention relative placement of the pre-nip and transport magnets is much more key than the relative placement of the pre-nip and development magnets. It is also to be noted that the pre-nip magnet 88 is not strictly positioned in a radial fashion with the development magnet 86. Rather, it is twisted somewhat, e.g. by between approximately 5° and approximately 15° relative to a radial reference line running through its centerline to obtain an effective field effect. The transport magnet 84 location is important as discussed below. Another feature of the transport magnet is that it is rectangular (not square).

The transport magnet preferably should have a height/width ratio of between 0.50 and 0.75. As excessive mix tries to get past the mix barrier, instead of passing by the barrier, it drops off at this point and falls back into the sump and does not go on to create problems of excess in the development area. It will be noted that the pre-nip magnet 88 is relatively weak compared with the development magnet 86. In this particular embodiment, the pre-nip magnet has a strength of 300 Gauss against a development magnet strength of 460 Gauss so that the pre-nip magnet has a value of about 65% of that of the development magnet. In practice the pre-nip magnet 88 may have a strength of between about 150 Gauss and about 300 Gauss while the strength of the development magnet 86 may vary between about 450 Gauss and about 550 Gauss. In relative terms the strength of the pre-nip magnet may vary between about 30% and about 60% of the strength of the development magnet. Preferably it has about half the strength of the development magnet.

As discussed above, with the arrangement of this invention, the setting of the mix barrier is not critically related to the setting of the nip gap 80. The nip gap of an arrangement as shown in FIG. 2 is preferably about six times the diameter of the carrier beads used in the developer mix so that for carrier beads of about 0.008 inch diameter, the nip setting is preferably of the order of 0.050 inch but depending on the carrier beads may vary between about 0.040 inch and about 0.060 inch.

The mix barrier setting is preferably within the range of about 0.090 inch to 0.100 inch. It may, however, vary between 0.090 inch and 0.200 inch. Thus it can be placed plus or minus 0.055 inch of its normal setting without adversely affecting the phenomenon of being able to hold approximately the same pressure and flow at the development nip.

With the arrangement of this invention a larger angle is possible between the development magnet and the transport magnet. It should be noted at this point that while a single transport magnet is shown, which is adequate for the size of roll utilized, more than one may be desirable in larger diameter rolls. In this embodiment, where the distance between the pick-up magnet 82 and the development magnet 86 is greater, a plurality of transport magnets presenting alternating poles may be utilized. In such case the angle discussed above is that between the development magnet and the nearest of the transport magnets. Thus, it has been found that this angle may be between about 90° and about 115°.

By varying the strengths of the pre-nip magnet 88 and the transport magnet 86, and the angle between these magnets, the flow and pressure limits of any given system can be altered. Suitable strengths for the pre-nip magnet 88 have been discussed above. The transport magnet may have a strength of between about 500 Gauss and about 600 Gauss. It's strength is about 560 Gauss in this specific embodiment.

The angle between the pre-nip magnet 88 and the transport magnet 84 may be between about 60° and about 75°, preferably about 65°. The position of the pre-nip magnet 88 relative to the development magnet 86 may also vary, but the ratio of the arcuate spacings between transport and pre-nip magnets and between pre-nip and development magnets should preferably not be less than 2:1.

Since only a portion of the toner will ordinarily be transferred from roll 60 to the surface 26 at the nip 80, the remaining developer mix is transported by roll 60 past the nip 80 and in to the vicinity of roll 62. The magnet assemblies of each of rolls 62, 64 and 66 are arranged in conventional manner to carry the blanket of developer material into contact with the photoconductor surface and transfer the blanket from one roll to the next. The magnet assembly of the last roll 66 is additionally designed to carry the depleted mix over the top of the roll array and return it to the sump. If the rolls are sufficiently large, additional magnets, such as representative magnet 92 in roll 62, may be added to assure good transport of the developer mix.

While the invention has been particularly shown and described with reference to a preferred embodiment thereof it will be understood by those skilled in the art that the foregoing and other changes in form and details may be made therein without departing from the spirit and scope of the invention.

I claim:

1. Magnetic brush development apparatus including a housing, a magnetic brush roll mounted in said housing and adapted to be arranged in closely spaced relation to a photoconductor surface to define a nip therebetween, said roll comprising a cylinder surrounding a magnet assembly, a developer supply source arranged to supply developer mix to said magnetic brush roll, for causing relative rotary movement between said cylinder and its associated magnet assembly to cause developer mix to be carried from said supply source to be brushed on to said photoconductor surface in a development zone at the nip between said magnetic brush roll and said photoconductor surface, and a mix barrier for limiting the flow of developer mix from said supply source to said photoconductor surface, said magnetic assembly including:

a development magnet positioned in use in the development zone at the nip between said magnetic brush roll and said photoconductor surface, at least one transport magnet for transporting said developer mix from said developer supply source to said nip, and a pre-nip magnet, having the same polarity as said development magnet, arranged ahead of the development zone between said development magnet and said at least one transport magnet, adjacent said development magnet, and so spaced from the transport magnet as to create a tangential field therebetween, said mix barrier being arranged between said transport magnet and said pre-nip magnet.

2. A magnetic brush development apparatus including a housing, a magnetic brush roll mounted in said housing and adapted to be arranged in closely spaced relation to a photoconductor surface to define a nip therebetween said roll comprising a cylinder surrounding a magnet assembly, a developer supply source arranged to supply developer mix to said magnetic brush roll, for causing relative rotary movement between said cylinder and its associated magnet assembly to cause developer mix to be carried from said supply source to be brushed on to said photoconductor surface in a development zone at the nip between said magnetic brush roll and said photoconductor surface, and a mix barrier for limiting the flow of developer mix from said supply source to said photoconductor surface, said magnetic assembly including:

a development magnet positioned in use in the development zone at the nip between said magnetic brush roll and said photoconductor surface, at least one transport magnet for transporting said developer mix from said developer supply source to said nip, and a pre-nip magnet, having the same polarity as said development magnet and the strength of which is less than that of the development magnet, arranged ahead of the development zone between said development magnet and said at least one transport magnet, adjacent said development magnet, and so spaced from the transport magnet as to create a tangential field therebetween, said mix barrier being arranged between said transport magnet and said pre-nip magnet.

3. A magnetic brush development apparatus according to claim 2 in which the strength of the pre-nip magnet is between about 30% and about 60% of that of the development magnet.

4. A magnetic brush development apparatus according to claim 3 in which the development magnet has a strength of between about 450 Gauss and about 550 Gauss and the pre-nip magnet has a strength of between about 150 Gauss and about 300 Gauss.

5. A magnetic brush development apparatus according to claim 1 in which the mix barrier is fixedly mounted on said housing.

6. A magnetic brush development apparatus according to claim 5 in which the mix barrier is integral with said housing.

7. A magnetic brush development apparatus according to claim 1 in which said mix barrier is made of aluminum.

8. A magnetic brush development apparatus according to claim 1 in which the spacing between the mix barrier and the magnetic brush roll is between about 0.090 inch and about 0.200 inch.

9. A magnetic brush development apparatus according to claim 1 in which the pre-nip and transport magnets are spaced between about 60° and about 75° of arc apart and the mix barrier is arranged between about 20° and about 25° from the transport magnet.

10. A magnetic brush development apparatus according to claim 1 in which the spacing between the pre-nip and transport magnets is at least twice the spacing between the pre-nip and development magnets.

11. A multi-roll magnetic brush development apparatus according to claim 1 including a plurality of further magnetic brush rolls each comprising a cylinder surrounding a magnet assembly and means for causing relative rotary movement between said cylinder and its associated magnet assembly to cause developer mix to be carried from one roll to the next for repeatedly toning a said photoconductor surface.

12. An electrostatographic printing machine of the type having an electrostatic latent image recorded on the photoconductor surface including a magnetic brush development apparatus including a housing, a magnetic brush roll mounted in said housing and arranged in closely spaced relation to said photoconductor surface to define a nip therebetween, said roll comprising a cylinder surrounding a magnet assembly, a developer supply source arranged to supply developer mix to said magnetic brush roll means for causing relative rotary movement between said cylinder and its associated magnet assembly to cause developer mix to be carried from said supply source to be brushed on to said photoconductor surface in a development zone at the nip between said magnetic brush roll and said photoconductor surface, and a mix barrier on to said photoconductor surface, and a mix barrier for limiting the flow of developer mix from said supply source to said photoconductor surface, said magnetic assembly including:

a development magnet positioned in use in the development zone at the nip between said magnetic brush roll and said photoconductor surface, at least one transport magnet for transporting said developer mix from said developer supply source to said nip, and a pre-nip magnet, having the same polarity as said development magnet, arranged ahead of the development zone between said development magnet and said at least one transport magnet, adjacent said development magnet, and so spaced from the transport magnet as to create a tangential field therebetween, said mix barrier being arranged between said transport magnet and said pre-nip magnet.

13. An electrophotographic printing machine according to claim 12 in which at least part of said developer housing on which said mix barrier is carried is an extrusion having said mix barrier integral therewith.

14. An electrophotographic printing machine according to claim 12 in which the developer roll to photoconductor surface spacing at the nip therebetween is between about 0.040 inch and about 0.060 inch and the spacing between the mix barrier and the developer roll is between about 0.090 inch and about 0.200 inch.

15. An electrophotographic printing machine according to claim 12 including a multi-roll parallel flow said magnetic brush development apparatus each roll being arranged to rotate in the same direction in closely spaced relation to the photoconductor surface and each comprising a cylinder surrounding a magnet assembly and means for causing relative rotary movement between said cylinder and its associated magnet assembly to cause developer mix to be carried from one roll to the next into repeated contact with said photoconductor surface.

* * * * *